US006958021B1

(12) United States Patent
Gustine

(10) Patent No.: US 6,958,021 B1
(45) Date of Patent: Oct. 25, 2005

(54) RESILIENT ADJUSTABLE HEIGHT GOLF TEE

(76) Inventor: Floyd L. Gustine, 5631 Curry Rd., Pittsburgh, PA (US) 15236

( * ) Notice: Subject to any disclaimer, the term of this patent is extended or adjusted under 35 U.S.C. 154(b) by 0 days.

(21) Appl. No.: 10/833,559

(22) Filed: Apr. 29, 2004

(51) Int. Cl.[7] ..... A63B 69/36
(52) U.S. Cl. ..... 473/396
(58) Field of Search ..... 473/386–403, 473/133, 279

(56) References Cited

U.S. PATENT DOCUMENTS 1,929,579 A * 10/1933 Garlando ..... 473/398
3,516,664 A * 6/1970 Wendell ..... 473/396
5,248,144 A * 9/1993 Ullerich ..... 473/279
5,728,013 A * 3/1998 Luther, Sr. ..... 473/396
5,766,100 A * 6/1998 Dilmore ..... 473/396
5,776,014 A * 7/1998 Gustine ..... 473/396
6,083,121 A * 7/2000 Hovey ..... 473/396
6,110,060 A * 8/2000 Spoto ..... 473/396
6,328,663 B1 * 12/2001 Lipstock ..... 473/396

* cited by examiner

*Primary Examiner*—Steven Wong
(74) *Attorney, Agent, or Firm*—Clifford A. Poff

(57) ABSTRACT

A tee assembly for teeing a golf ball in a playing field uses a tubular elastomeric golf ball to support the ball at one end and fitted with a threaded nut at the opposite end for forming an internally threaded base. A threaded elastomeric shaft is anchored against rotation about an elongated central axis to the flanged base beneath a playing field to resiliently extend in an upstanding manner through an aperture in the playing field along a distance sufficient to correspond to the selectable range of elevations. The external threads of elastomeric shaft are in mating engagement with the internally threaded base to resiliently restore the elastomeric golf ball support to the selected elevation above such a playing filed. An abutment mounted on a protruding terminal end of the elastomeric shaft prevents disengagement of the tubular golf ball support from the elastomeric shaft.

10 Claims, 1 Drawing Sheet

RESILIENT ADJUSTABLE HEIGHT GOLF TEE

CROSS-REFERENCE TO RELATED APPLICATIONS

Not applicable

BACKGROUND OF THE INVENTION

1. Field of the Invention

The present invention relates to a tee for supporting a golf ball at a selectable elevation above a playing field, and, more particularly to a tee assembly embodying a resilient threaded shaft for adjustably positioning and resiliently restoring an elastomeric golf ball support within a range of selectable elevations above the playing field.

2. Description of the Prior Art

As is well known in the art, it is a common practice to use a tee, usually made of wood, to support a golf ball at a selected height above a playing field so that a golf club can be impacted with the golf ball. This mode of driving a golf ball is practiced at a teeing area as well as at a driving range. The soil condition relevant to obtaining a stable support and overall length of the tee establish the selectable height of support for the golf ball above the playing field. A golf ball tee of this type is frequently dislodged from the playing field and broken upon impact with the golf club. Natural or artificial turf at driving ranges is used by golfers to practice driving golf balls for distance and accuracy. A one-piece elastic tee may be incorporated in a section of artificial turf by forming an annular passage in the turf to allow a tubular ball support section to extend above the playing field. The height of the tee above the playing field can be adjusted only by cutting a short length from the tubular ball support section. The golfer cannot be given the option of simulating the conditions in a tee box in a golf course of precisely selecting the height at which the golf ball is supported above the playing field. It is desirable to practice the golf swing and associated techniques for driving golf balls by simulating some of the actual golf course environments including practice from the tee box where the golf ball is usually located on a tee above the playing field and in the rough where a golf ball is supported on taller grass above ground level as well as while supported generally close to ground level in a fairway.

A need therefore exists for an adjustable golf ball tee operable to support a golf ball at a height that can be selected from a range of a position generally level with the playing field to an extended position, which is free and clear above the playing field. In my earlier U.S. Pat. No. 5,776,014, there is disclosed an adjustable golf tee formed by an elongated golf ball support having a golf ball support surface and a base at opposite ends. A threaded carrier extends from the base in a direction opposite to the golf ball support surface and a receiver is supported in a cavity extending beneath the playing field. The receiver has an internal cavity for guiding and supporting the elongated golf ball support. A threaded nut is positioned within the internal cavity of the receiver and threadable receives the carrier for adjustably positioning the golf ball support surface at a predetermined distance beyond the receiver and above such a playing field. A stop member on the end portion of the threaded carrier is used to fix and limit the extent to which the elongated golf ball support can project above the playing field. The requirement for a cavity beneath the playing field to receive and support the receiver is not always desirable to create and maintain.

Additionally, the resiliency of the golf ball support is restricted to an inward collapse of the tubular hollow configuration of the receiver should the support be struck by the golf club. The resiliency of the conventional one-piece golf tee is similarly restricted by the inward collapse of the ball support above the conventional golf mat found in a golf driving range. Other drawbacks are the restriction to the location of the playing field along the bench of the driving range and the need for multiple cavities in the bench usually a concrete slab at each playing field to accommodate both left and right-handed golf players. The cavities offer sites for the accumulation of debris and erosion to the cavity wall create the need for maintenance.

It is an object of the present invention to provide an adjustable height golf ball tee embodying a construction which includes a resilient height adjustor made of an elastomeric plastic which allows placement and support of the golf tee upon on the planar face of a bench at a driving range and use of the playing field to anchor and support the adjustable tee.

It is a further object of the present invention to provide an adjustable height tee for a golf ball embodying a construction to provide a ball support surface supported by an underlying resilient adjuster sufficiently elastic to reliably return the ball support surface to an originally set condition and site with long continued integrity.

SUMMARY OF THE INVENTION

According to the present invention there is provided a tee assembly for teeing up a golf ball in a playing field, the tee assembly including the combination of an elastomeric golf ball support having a golf ball support surface and an internally threaded base at opposite ends thereof, the elastomeric golf ball support being elongated by a distance sufficient to support a golf ball within a selectable range of elevations above such a playing field, a flanged base having opposed load-bearing surfaces for anchored support at an underlying site beneath such a playing field, an elastomeric shaft anchored against rotation about an elongated central axis thereof to the flanged base to resiliently extend in an upstanding manner toward such a playing field along a distance sufficient to correspond to the selectable range of elevations, the elastomeric shaft having external threads in mating engagement with the internally threaded base to resiliently restore the elastomeric golf ball support to the selected elevation above such a playing filed, and an abutment mounted on a protruding terminal end of the elastomeric shaft to prevent disengagement of the golf ball support from the elastomeric shaft.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 2:
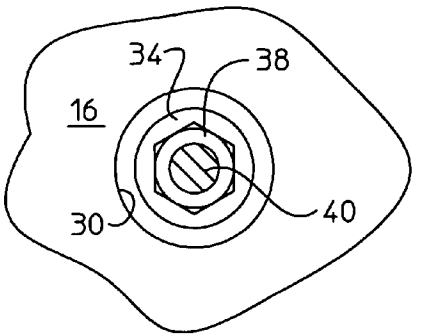
FIG. 2 is a sectional view taken along lines II—II of FIG. 1.
Figure 1:
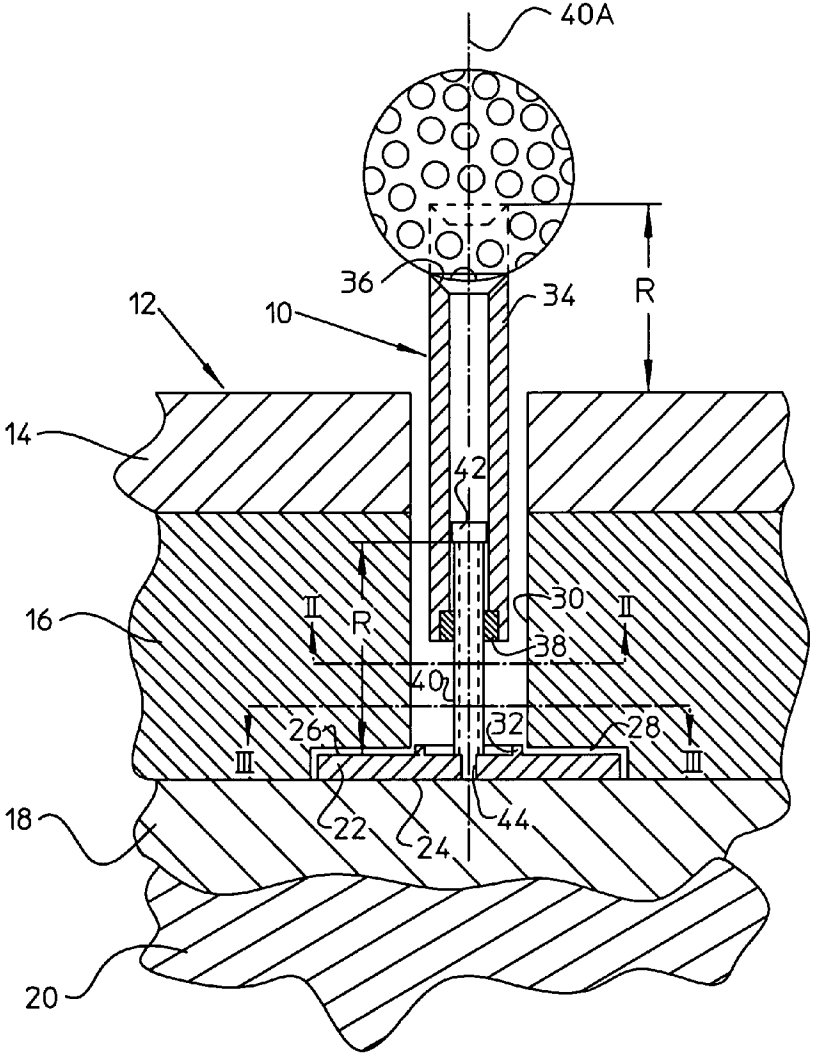
FIG. 1 is an elevational view in section along a central axis for illustrating the construction of the adjustable golf ball tee arranged below grade to a playing field according to the present invention.

According to the present invention there is provided an adjustable golf ball tee 10 particularly useful in a driving range and, as shown in FIG. 1, there is a playing field 12 formed by a layer of artificial turf 14 secured to a rubber sponge mat 16 that is in turn supported upon a platform 18 comprising concrete, for example. The platform 18 is cast or otherwise built on an earthen base 20. As shown in FIGS. 1 and 2, the lower terminal end portion of the adjustable golf tee has a disk shaped flanged base 22 preferably comprised of rigid plastic with a planer load bearing support surface 24 extending to an annular edge with a chamfer joining the upper load bearing support surface 26. The flanged base is seated into a correspondingly shaped annular cavity 28 formed in the lower face of the rubber sponge mat 16 to avoid an upward protrusion of the artificial turf in the area surrounding the golf ball tee 10 otherwise caused by the thickness of the flanged base 22. The annular cavity 28 in the mat 16 intersects with a vertically extending annular aperture 30 formed in both the rubber sponge mat 16 and the layer of artificial turf 14. The diameter of the annular aperture 30 is slightly larger than the outside diameter of an annular upstanding rim 32 on the upwardly directed load bearing support surface 26 of the flanged base 22, for interlocking with an annular passage 30 in the playing field 16.

As shown in FIGS. 1 and 2, the wall of the annular aperture 30 loosely confines a vertically orientated elongated tubular ball carrier 34 having a chamfered upper end forming a ball engaging surface 36 and opposite thereto is a fixation site containing a plastic threaded hexagon nut 38. A layer of adhesive is used to adhere the nut 38 to the inner wall of the tubular ball carrier 34. Plastics are the most desired materials for forming the nut 36. Such desired plastic materials are acetates, nylon and polyurethane.

An elastomeric threaded shaft 40 has threads in mating engagement with the threads of the nut 38. The shaft is suitable comprised of plastic such as polyurethane which insures a self-lubricating relation with nut 38 for ease of rotation of the nut and ball carrier 34 about the elongated central axis 40A of the shaft 40. The plastic of the shaft has Durometer hardness reading of between 30 and 90 shore (A) preferably a Durometer reading of 90 shore (A) and a diameter of between ¼ and 5/16 inch to promote the desired resilient, flexibility.

Figure 3:
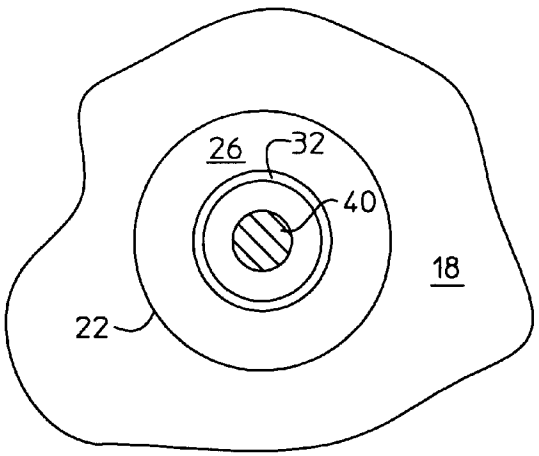
FIG. 3 is a sectional view taken along lines III—III of FIG. 1.

As shown in FIGS. 1 and 3, one end of the shaft 40 contains a stop disk 42 and the opposite end is provided with a reduced diameter portion 44 that is anchored by the use of adhesive in an aperture formed at the geometrical center of the flanged 22. The flange base is firmly anchored in the cavity 28 of the mat to resist torque applied to the ball carrier 34 when it is advanced and retracted as the nut member moves along the elastomeric threaded shaft 40. A stop disk 42 on the upper terminal end of the elastomeric threaded shaft establishes the predetermined distance R to the upper load bearing support surface 26 of the flanged base. The elongated tubular ball carrier 34 is preferably made from molded plastic, such as nylon or synthetic rubber, having a Durometer reading of 60 Shore (A) or less, preferably in the range of 50 to 60.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A tee assembly for teeing up a golf ball in a playing field, said tee assembly including the combination of:

an elastomeric golf ball support having a golf ball support surface and an internally threaded base at opposite ends thereof, said elastomeric golf ball support being elongated by a distance sufficient to support a golf ball within a selectable range of elevations above such a playing field;

a flanged base having opposed load-bearing surfaces for anchored support at an underlying site beneath such a playing field;

an elastomeric shaft anchored against rotation about an elongated central axis thereof to said flanged base to resiliently extend in an upstanding manner toward such a playing field along a distance sufficient to correspond to said selectable range of elevations, said elastomeric shaft having external threads in mating engagement with said internally threaded base to resiliently restore said elastomeric golf ball support to the selected elevation above such a playing filed; and an abutment mounted on a protruding terminal end of said elastomeric shaft to prevent disengagement of said golf ball support from said elastomeric shaft.

2. The tee assembly according to claim 1 wherein said flanged base is seated in a recess between an underlying plainer support surface and a recess in an overlying playing field.

3. The tee assembly according to claim 1 wherein said elongated central axis of said elastomeric shaft is coaxial with axis of threads comprising said external threads.

4. The tee assembly according to claim 3 wherein elastomeric shaft is defined by an outside diameter within a range of between ¼ and 5/16 inch.

5. The tee assembly according to claim 1 wherein said abutment comprises a stop protruding from an end of said elastomeric shaft remote to said flanged base.

6. The tee assembly according to claim 1 wherein said elastomeric shaft is defined by Durometer hardness of between 30 and 90.

7. The tee assembly according to claim 1 wherein said internally threaded base is a plastic insert secured by an adhesive to said elastomeric golf ball support.

8. The tee assembly according to claim 1 wherein said internally threaded base is a threaded nut member supported within an end portion of said elastomeric golf ball support.

9. The tee assembly according to claim 1 wherein said elastomeric golf ball support is tubular.

10. The tee assembly according to claim 1 further including an annular rim upstanding from said flanged base for interlocking with an annular passage in such a playing field to control the position of said base relative to said annular passage.

* * * * *